US009739024B2

(12) United States Patent
Ong

(10) Patent No.: US 9,739,024 B2
(45) Date of Patent: Aug. 22, 2017

(54) END PLATE FOR CONCRETE PILES

(71) Applicant: Chin Chai Ong, Kuala Lumpur (MY)

(72) Inventor: Chin Chai Ong, Kuala Lumpur (MY)

( * ) Notice: Subject to any disclaimer, the term of this patent is extended or adjusted under 35 U.S.C. 154(b) by 109 days.

(21) Appl. No.: 14/421,082

(22) PCT Filed: Feb. 19, 2014

(86) PCT No.: PCT/MY2014/000018
§ 371 (c)(1),
(2) Date: Feb. 11, 2015

(87) PCT Pub. No.: WO2015/026223
PCT Pub. Date: Feb. 26, 2015

(65) Prior Publication Data

US 2015/0345096 A1 Dec. 3, 2015

(30) Foreign Application Priority Data

Aug. 21, 2013 (MY) ..... PI 2013701893

(51) Int. Cl.
*E02D 5/22* (2006.01)
*E02D 5/30* (2006.01)
*E02D 5/52* (2006.01)
*E02D 5/24* (2006.01)

(52) U.S. Cl.
CPC ..... *E02D 5/526* (2013.01); *E02D 5/223* (2013.01); *E02D 5/226* (2013.01); *E02D 5/24* (2013.01); *E02D 5/30* (2013.01)

(58) Field of Classification Search
CPC E02D 5/30; E02D 5/523; E02D 5/526; E04B 1/215; F16B 5/0044; F16B 5/0052; F16B 5/002
USPC ..... 405/252; 403/331, 335
See application file for complete search history.

(56) References Cited

U.S. PATENT DOCUMENTS 3,504,500 A * 4/1970 Fristedt ..... E02D 5/523 285/360
3,953,981 A * 5/1976 Axelsson ..... E02D 5/523 403/336
4,157,230 A 6/1979 Tomt et al.
2009/0263189 A9* 10/2009 Koivunen ..... E02D 5/523 403/379.4

FOREIGN PATENT DOCUMENTS

AT EP 0135716 A1 * 4/1985 ..... E02D 5/523
CN 202323937 7/2012
DE 1213357 B * 3/1966 ..... E02D 5/523
(Continued)

OTHER PUBLICATIONS

English Abstract of JP 2006207117.
(Continued)

*Primary Examiner* — Benjamin Fiorello
*Assistant Examiner* — Stacy Warren
(74) *Attorney, Agent, or Firm* — Preston Smirman; Smirman IP Law, PLLC

(57) ABSTRACT

A system for joining two separate spun piles by interlocking together a top end plate located at a bottom end of a first spun pile to a bottom end plate located at a top end of a second spun pile, wherein the end plates each have a plurality of segments comprising an equal number of segmental protrusions and segmental recesses.

18 Claims, 14 Drawing Sheets

(56) References Cited

FOREIGN PATENT DOCUMENTS

| | | | | |
|---|---|---|---|---|
| EP | 0891454 | | | 4/2003 |
| EP | 1403436 | | | 3/2004 |
| JP | 10195868 | | | 7/1998 |
| JP | 2004300846 | | | 10/2004 |
| JP | 20062560 | | | 1/2006 |
| JP | 2006002560 | A | * | 1/2006 |
| JP | 2006207117 | | | 8/2006 |
| JP | 2006207117 | A | * | 8/2006 |
| WO | 9738173 | | | 10/1997 |

OTHER PUBLICATIONS

English Abstract of JP 10195868.
English Abstract of JP 20062560.
English Abstract of JP 2004300846.
Unpublished MY PI2012700742.
English Abstract of CN 202323937.

* cited by examiner $$F_b = \frac{2Ldf_b}{\sqrt{2}} \quad ; \quad F'_b = \frac{Ldf_b}{2}$$

$$\frac{F_b}{F'_b} = \frac{4}{\sqrt{2}} = 2.83$$

Where;
d = square pin cross-section width
L = Length of the square pin in contact
$F'_b$ = compression force for the horizontal pin
$F_b$ = compression force for the rotated pin
$f_b$ = normal stress by jamming of the tapered pin

END PLATE FOR CONCRETE PILES

CROSS-REFERENCE TO RELATED APPLICATION

The instant application is a national phase of PCT International Patent Application Serial No. PCT/MY2014/000018, filed Feb. 19, 2014, and claims priority to Malaysian Patent Application Serial No. PI 2013701893, filed Aug. 21, 2013, the entire specifications of both of which are expressly incorporated herein by reference.

FIELD OF INVENTION

The present invention relates to an interlocking end plate connector attached to the ends of a concrete pile for joining the end of one concrete pile to the end of another adjoining concrete pile. The tapered square pin is rotated 45 degrees to the vertical axis of the pile for maximum engagement of the tapered square pin with the tapered square passageway formed by the mated end plates. The interlocked end plates have a safe bending moment and tension capacity that exceeds the reinforced concrete pile section. In addition this invention is adapt to suit heavy pile driving using heavy drop hammer impact onto the top of the end plate without damaging the interlocking grooves.

BACKGROUND OF THE INVENTION

Reinforced concrete (RC) pile and prestressed high tensioned concrete spun (PHC) pile are capped at the ends with normal steel end plates that do not have a mechanical means to joint to each other except by site welding. It is cumbersome to use mechanical pile splices or connectors that consist of many small and fragile parts such as bolts, pins, washers, shear keys etc. In addition, these fragile parts of the connectors as mentioned above will require additional opened accesses such as grooves or holes that reduces the contact surface of the end plate for load transfer, and therefore the pile connectors must be fortified with flanges or wedges. Of recent, there are many patents filed in Korea that teach the use of various intermediate steel connectors that are used like adaptors placed in between the end plates of the spun piles. The use of an additional steel intermediate connector incurs extra cost. Further, these intermediate connectors are usually welded from smaller parts which tend to introduce additional weakness. Whereas in this invention, the end plate is hot forged from steel and precasted into ends of the spun pile A pending patent PI2012700742 is filed in Malaysia by the same inventor that relates to an article for joining concrete piles which has overcame several drawbacks in the prior arts as referred to above. However in this present invention, many further improvements has been made as compared to PI2012700742; 1) The present end plate is designed to take heavy hammer impact without sustaining damages to the end plate's interlocking dovetail grooves. 2) In PI2012700742, thicker end plates are necessary to accommodate the prestressed steel tendon button head such that it is placed at least flush or below the top surface of the end plate and yet provide sufficient remaining depth in the end plate for the prestressed steel tendon seating to avoiding material punching failure through the base of the end plate. However in this invention, material savings is achieved by reducing the overall thickness of the steel end plate through creating segmental protrusions and segmental recesses of generally similar thickness, and in addition to this feature each segments have localised hot forged indentations that creates deeper sections for the prestressed steel tendon button head and seating. As a result of reducing the overall thickness, there is a material saving of at least 30% to 45% as compared to PI2012700742. 3) Another crucial feature lies in the 45 degrees rotation of the square openings to the vertical axis of the pile resulting in the edges of the segmental protrusion and recesses having like dovetail grooves when viewed from the side elevation. This 45 degrees orientation gives maximum contact surface between the tapered square pin and tapered square passageway. Further with this 45 degrees rotation, the tapered square opening can accommodate a tapered square pin that is 40% larger in size as compared to the prior art if the square pin is placed in the horizontal position. This is advantageous because by jamming and forcing the tapered square pins into the tapered square passageway of the mated end plates, it has higher axial compression force of 283% as that for the square pin placed in the horizontal position. The prior patent PI2012700742 specified a tapered passageway of a square shape but did not teach about the rotation angle in the axis of the pile. 4) The transfer of tension in the prestressed steel tendons across the connected piles is also improved by placing the vertical prestressed tendons in close proximity to horizontal interlocked tapered square pins instead of being located at the centre of the segmental protrusions or segmental recesses as in PI2012700742. Thus, when the pile is resisting a bending moment, the resulting additional tension in the vertical prestressed steel tendons will pull the end plate along the axis of the tendons and thereby bends the end plate, but this bending effect is considerably reduced by the close distance of the top and bottom vertical prestressed steel tendons to the horizontal interlocked tapered square pins. 5) To avoid seepage of grout through the end plate and the sides of the spun pile's mould during spinning, there is a provision to secure a circular steel skirt to the end plate by means of providing outer segmental side edges on the underside of the segmental protrusions so that there is sufficient thickness for a deep rectangular groove to traverse the circumference of the end plate such that it can embed the proximal lipped edge of the circular steel skirt. 6) In another adaptation of the present invention for use in a solid square concrete piles which is more common as compared to square hollow concrete piles, the alignment of the dovetail groove in the plan view of the end plate has been altered to avoid a sharp kink angle. A problem is encountered in the side milling process of a dovetail groove because a length of about half a diameter of the dovetail cutter to a sharp kink angle is obstructed. It is impossible to side mill the dovetail groove throughout its entire length unless there is a central opening in the end plate which is bigger than the diameter of the side mill cutter as in PI2012700742. Alternatively, this problem may be alleviated by using localised electrical induction to heat the interlocking edge of the end plate to about 1000° C. and hot forged the edge into a dovetail groove shape with specialised conforming die with the corresponding sharp kink angle, but this process is expensive as many specialised dies needs to be customised for different sizes of end plate.

In the CN 201120356388, this utility model claims a pre-stressing force concrete pipe pile machine fast connector is composed of tubular pile connected with the inclined plate in clamping block clamping block bolt and screw cap. Pipe pile is set in the connecting plate is symmetrically distributed with 3-8 radial locking groove each which is set on the bolt radial through hole at the inner ring of the groove with inner inclined clamping block the axial direction of the square hole. Outer clamping piece of inner surface of the gear shape of the outer surface of the clamping block is set in the centre of which is set on the bolt through hole. This utility teaches that the force derived from the clamping bolts is acting perpendicular to the vertical axis of the pile, and the horizontal clamping force is to grip the lateral edges of the pile into place by friction. Whereas in the present invention, the axial clamping force is derived not by tightening bolts but by jamming the tapered square pin which creates a expansionary force inside the tapered square passageway on the opposing contact surfaces along the grooves of the top segmental protrusion and the bottom segmental recess which finally presses the mated flat surfaces of the end plates very tightly together hence giving a stiffer performance under a pile bending moment.

An example of such pile connector is known in U.S. Pat. No. 4,157,230, whereby a nut is constructed within the joining ends of the two pile sections for a threaded bolt to be fastened to the nuts. The nut is provided with an annular groove having radially directed locking notches in the bottom. A locking disk is inserted into the groove. The disk has resilient locking tongues with radial edges which are directed against the unscrewing direction and which engage with the notches in the nut. One specific drawback is the dimensional accuracy required by this mechanical bolted splice as specified by the author is that the end surfaces of the abutting pile sections must be extremely plane in order to obtain as strong a connection between the sections as possible. Whereas in reality, under heavy hammer impact, the end surface be stressed and distorted.

In the EP0891454B1, the object of the invention is a stiff adjoining piece for joining concrete piles, particularly reinforced piles, end to end so that those ends of the concrete piles which are joined together comprise base plates that is provided with a cavity that receives the locking bar, and the groove extending as a toroid around the cavity, and with a hole extending from this groove at least approximately in a tangential direction; and of an insert pin which, when the pile joint is made, is driven into the hole so that it rums around the locking bar in the cavity, guided by the circumferential face of the groove, whereby it is simultaneously locked permanently in place because of plastically deformation. This invention specifically uses a round bar as a deformable lock pin whereas the present invention teaches the use of stiff tapered square pin.

In EP1403436A2, it concerns a pile connecting structure for connecting upper pile and lower pile to each other, at the connecting portion between the upper pile and the lower pile, by screwing bolts inserted in circular-shaped bolt inserting holes formed in the connecting to the bolt hole in the end plate of the pile on one side, where the head of the bolts screwed to the end plate of the pile on the other side is inserted in the large diameter portion of heteromorphic bolt insertion holes communicating between a large diameter portion which the head of the bolts formed on the connecting plate can pass through making the other pile and the connecting plate move relatively so that the bolts may shift from the large diameter portion of the heteromorphic bolt insertion holes to the small diameter portion. The drawback lies in that twice as many bolt insertion holes is required which weakens the pile connector and demands precision in manufacturing and also leads to difficulty in manipulating the bolts into the smaller diameter heteromorphic bolt insertion holes through twisting heavy piles. The current invention overcomes these problems during mating of the end plates with the tapered edges of the interlocking end plates and generous tolerance provided in the gaps to easily lower the segmental protrusions vertically into the segmental recesses. The tapered square pins can then be easily inserted and jammed into the tapered square passageway created by the mating of the end plates.

SUMMARY OF INVENTION

The main aspect of the present invention is to provide to an interlocking end plate connector attached to the ends of a concrete pile for joining the end of one concrete pile to the end of another adjoining concrete pile having a safe bending moment and tension capacity that exceeds the reinforced concrete pile section.

Another aspect of the present invention is to suit heavy pile driving using drop hammer impact onto the top of the end plate without damaging the interlocking grooves.

Another aspect of the present invention is the 45 degrees rotation of the square openings having a width of "d" to the vertical axis of the pile gives the maximum contact surface and compression force between the tapered square pin and tapered square passageway, and requires a minimum depth of 1.4d for the tapered square passageway when mating the tapered dovetail groove of the segmental protrusion with segmental recess. Otherwise it would require a end plate thickness of at least 2d for the square pin passageway using the horizontal square pin.

Another aspect of the present invention is that the 45 degrees rotation of the square openings of the vertical axis of the pile provide a axial clamping force that is derived by jamming the tapered square pin into the square opening which creates a vertical clamping force in the axis of the pile that presses the surfaces of the end plates into contact very tightly together hence giving a stiffer performance under a pile bending moment.

Another aspect of the present invention is to provide an end plate for joining concrete spun piles that do not require a male and female locking mechanism or use of intermediate connectors or adaptors.

Another aspect of the present invention is to reduce weight of the end plate without sacrificing the strength by reducing the overall thickness of the steel end plate through creating segmental protrusions and segmental recesses of generally similar thickness with each segments having localised hot forged indentations that creates deeper sections for the prestressed steel tendon button head and seating.

Another aspect of the present invention is a provision to secure a circular steel skirt to the end plate.

Another aspect of the present invention is providing outer segmental side edges on the underside of the segmental protrusions so that there is sufficient thickness for a deep rectangular groove to traverse the circumference of the end plate such that it can embed the proximal lipped edge of the circular steel skirt Another aspect of the present invention provides a method of attaching the circular skirt to the end plate to avoid seepage of grout through the end plate and the sides of the spun pile mould during spinning.

Another aspect of the present invention is to suit the manufacturing of the end plate made from a single piece of forged steel and milling of the rough forged end plate.

Still another aspect of the present invention is to provide an article for joining concrete piles that has a sufficient tolerance to mate the end plates easily.

At least one of the preceding aspects is met, in whole or in part, by the present invention is best described consisting of a top end plate (1*a*) and bottom end plate (1*b*) for joining two separate spun piles by interlocking together at the top end plate (1*a*) located at the bottom end of the first spun pile (16*a*) to the bottom end plate (1*b*) located at the top end of the second spun pile (16*b*). The end plates (1*a*,1*b*) are identical and similar except in the orientation where the flat surfaces of the end plates (1*a*,1*b*) is the exposed outwards and rotated by the interposing angle such that the proximal end plate's segmental protrusion (8*a*,8*b*) is in line matching to the distal end plate's segmental recess (7*a*,7*b*). As a result equal length of steel tendons can be placed between the end plates. During manufacturing of the steel tendon cage for production of the spun piles, it is important that the equal cut lengths can be placed into a circular steel tendons ribbed cage for automatic welding machine to suit the client's machines. A 45 degrees rotation of the square openings (4) is formed from matching the tapered dovetail groove (14) of the top segmental protrusion (8*a*) with the bottom segmental recess (7*b*) and top segmental recess (7*a*) with the bottom segmental protrusion (8*b*) wherein a corresponding tapered square pin (3) can be jammed therethrough an opening (4) to securely interlocked the end plates together.

The preceding aspects of the invention also covers the manufacturing of the spun pile using the end plates (1*a*,1*b*); one proximal edge of the circular steel skirting (11*a*,11*b*) is pressed into a "L-shaped" lip and forced into the deep rectangular circumferential grooves (6*a*,6*a*) of the end plates (1*a*,1*b*) by using a rolled formed machine such that the inner sides of the circular steel skirting (11*a*,11*b*) is in very close contact with the sides of the end plates (1*a*,1*b*). In this way a tight enclosure is formed so that the cement grout cannot escape through the gaps between the steel skirting (11*a*,11*b*) and the end plates (1*a*,1*b*) when the infilled concrete is poured into the spun pile mould containing the two end plates (1*a*,1*b*) at each end of the spun pile (16*a*,16*b*) and spun to densify the concrete.

A second preferred embodiment of the present invention comprises a square end plate (22*a*,22*b*) which is mounted at the ends of a solid square concrete pile (26*a*,26*d*) with steel bars (25*a*,25*b*) welded flush to the top of the square end plate (22*a*,22*b*). The top end plate (22*a*) has segmental protrusion (29*a*) and segmental recess (28*a*) with a dovetail grooves (24), and the bottom end plate (22*b*) has segmental protrusion (29*b*) and segmental recess (28*b*) with a dovetail grooves (24). The end plates (22*a*,22*b*) are not identical and can only be mated in two orientation by rotating 180 degrees around the vertical axis. The top square end plate (22*a*) of the top section concrete square pile (26*a*) is mated with the bottom square end plate (22*b*) of the bottom section concrete square pile (26*b*), a tapered square passageway is formed in each side edge of the segments. By jamming and forcing the tapered square pins (23) into the tapered square passageway (24) of the mated end plates (22*a*,22*b*), the two end plate presses against each other and bindingly interlocked as an integral squared solid concrete pile (21). So this invention can be used for a solid square concrete piles without the use of indentations to increase the thickness of the square end plate (22*a*,22*b*) because the steel bars (25*a*,25*b*) is welded to the square end plate (22*a*,22*b*).

DETAILED DESCRIPTION OF THE INVENTION

Figure 1:
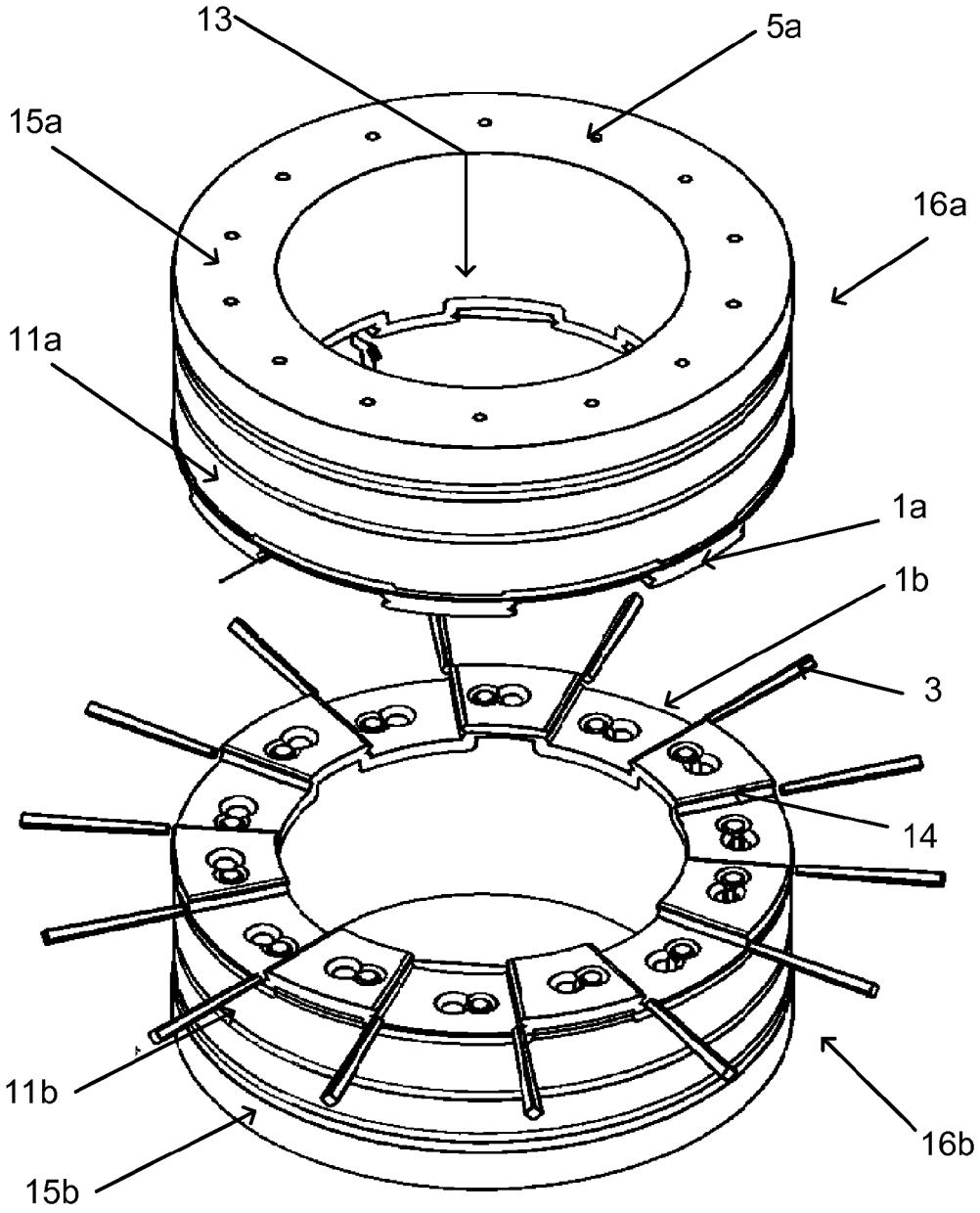
FIG. 1 shows the separated upper first spun pile and lower second spun pile with the attached top end plate attached to the base of the first spun pile and the bottom end plate attached to the top of the second spun pile.
Figure 2:
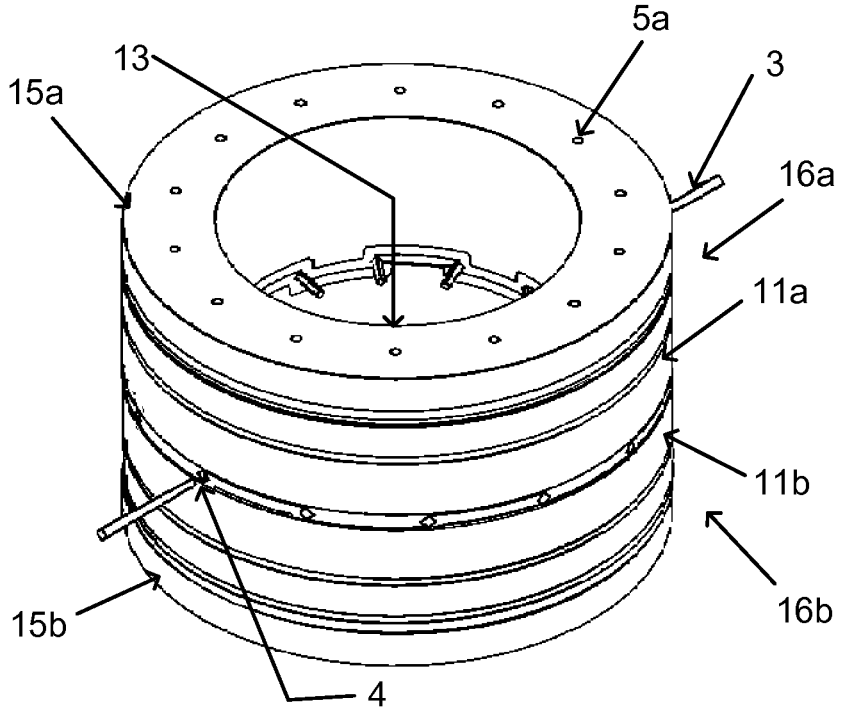
FIG. 2 shows the mated top and bottom spun piles with the tapered square pins inserted through the openings into the tapered square passageway.
Figure 3:
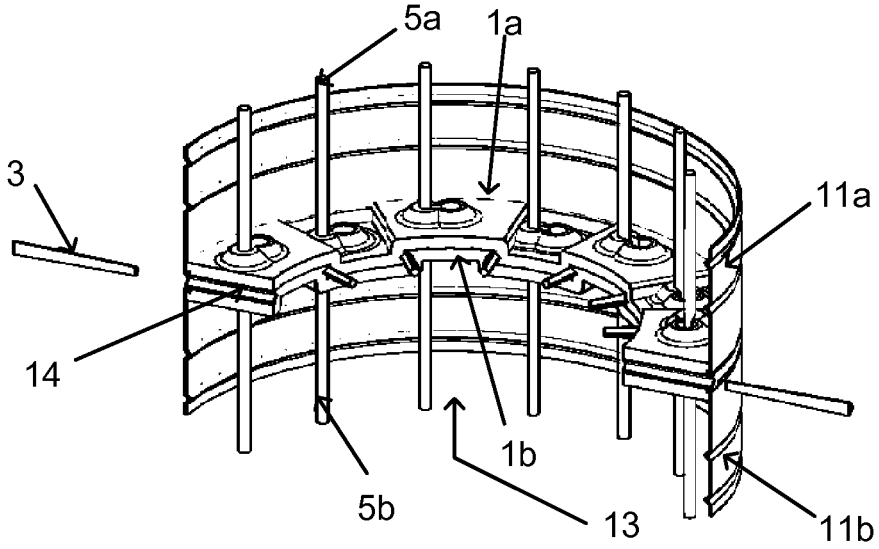
FIG. 3 shows the dissected components in the preferred embodiment of the present invention with the mated top and bottom end plates, top and bottom vertical steel tendons and top and bottom circular skirt exposed without the concrete.
Figure 4:
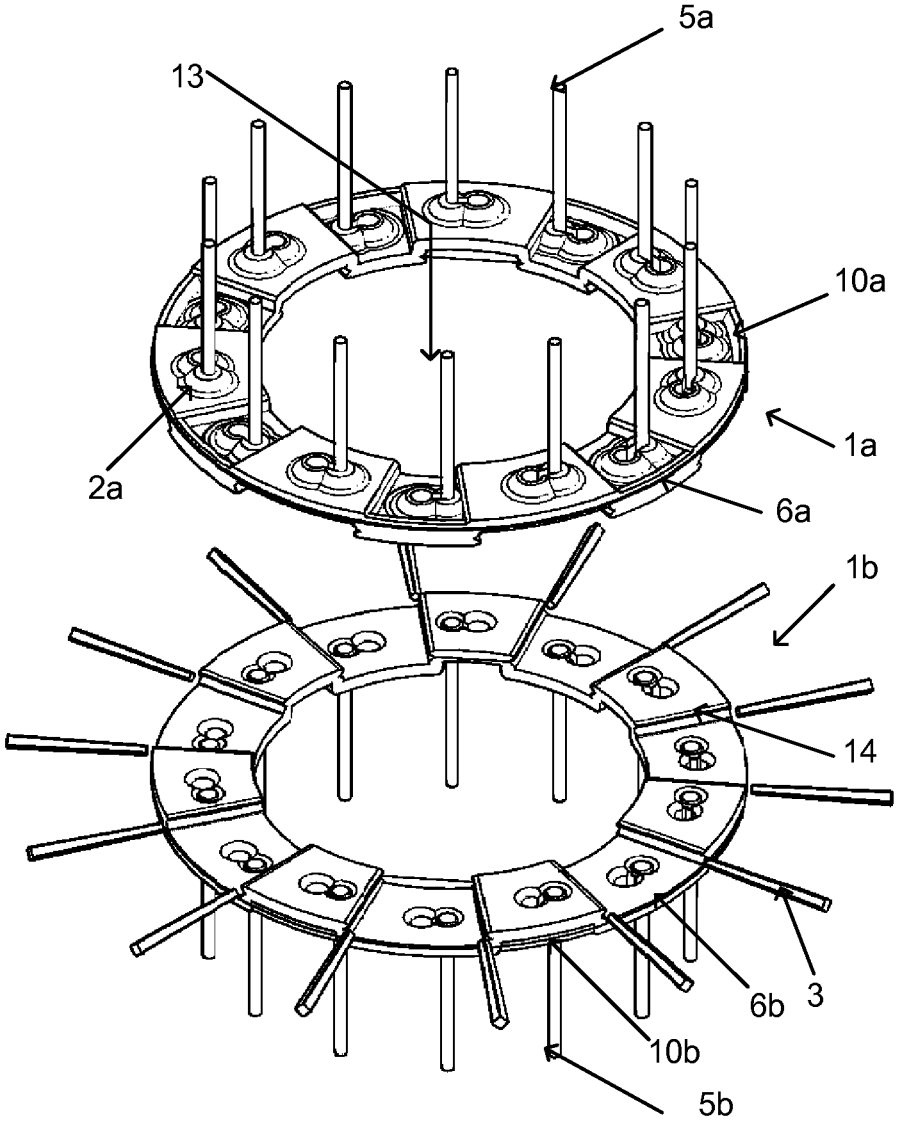
FIG. 4 shows the separated top and bottom end plates and top and bottom circular skirt exposed without the concrete and circular skirt.

Referring to FIG. 1, the present invention discloses a pair of identical top end plate (1*a*) and bottom end plate (1*b*) for joining two separate spun piles by interlocking together at the top end plate (1*a*) located at the bottom end of the first spun pile (16*a*) to the bottom end plate (1*b*) located at the top end of the second spun pile (16*b*). The top annulus spun concrete (15*a*) and bottom annulus spun concrete (15*b*) is cast in place in a factory with the steel tendons (5*a*,5*b*) placed as a welded ribbed cage inside the mould, after which wet concrete poured into it and the mould is closed, following which the tendons are prestressed against the ends of the strong mould and spun to compact the concrete and allowed to cure before removing the spun pile from steel mould.

Figure 5:
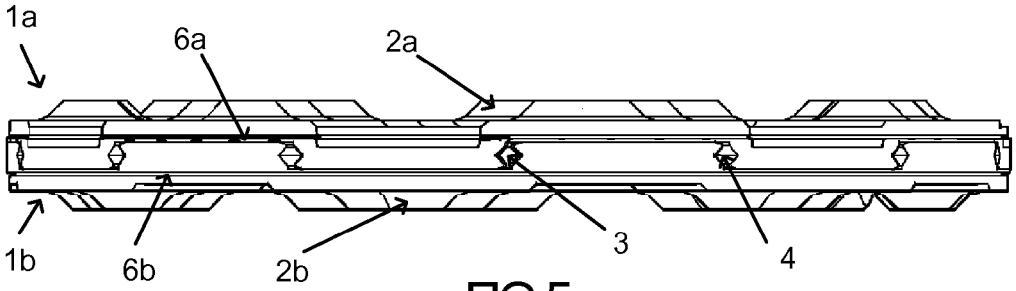
FIG. 5 shows the side view of the mated top and bottom end plates with the tapered square pins, the top and bottom indentations to the top and bottom end plates, and the top and bottom circumferential grooves to the top and bottom end plates respectively.
Figure 6:
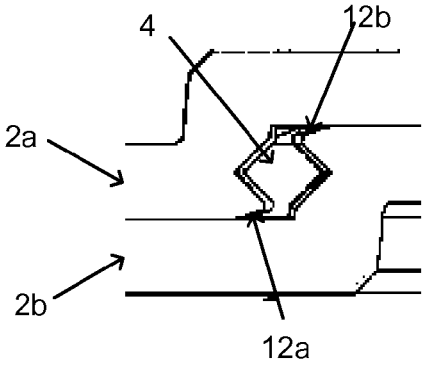
FIG. 6 shows the detailed side view of the 45 degrees rotation of the square openings to the tapered square passageway of the mated top and bottom end plates.
Figure 7:
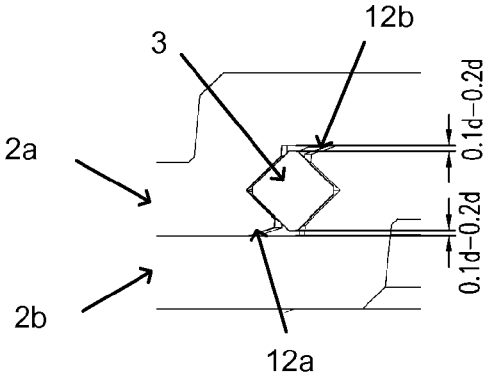
FIG. 7 shows the detailed side view of the square pin inserted to the opening of the square passageway created by mating of the top and bottom end plates.
Figure 8:
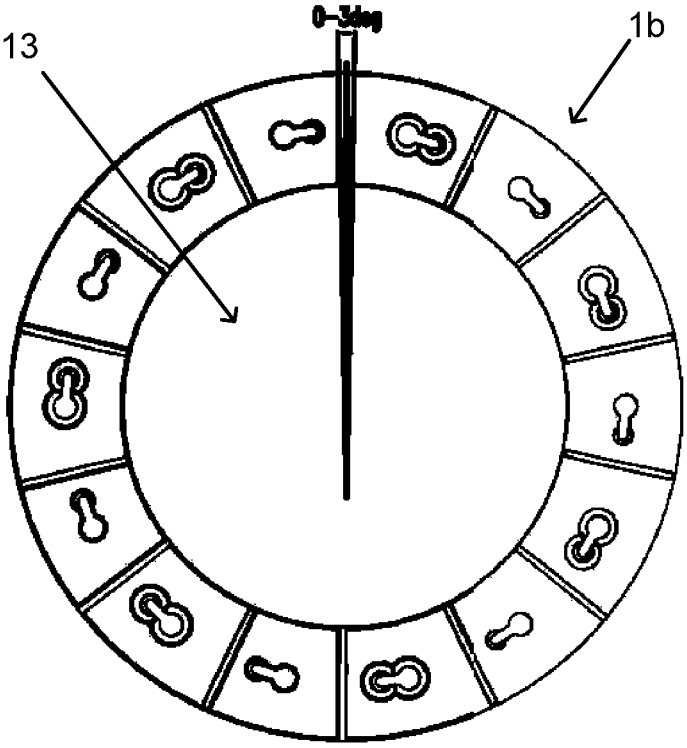
FIG. 8 shows the overall plan view the tapering alignment of the square passageway from 0-5 degrees towards the center of the annulus end plate
Figure 12:
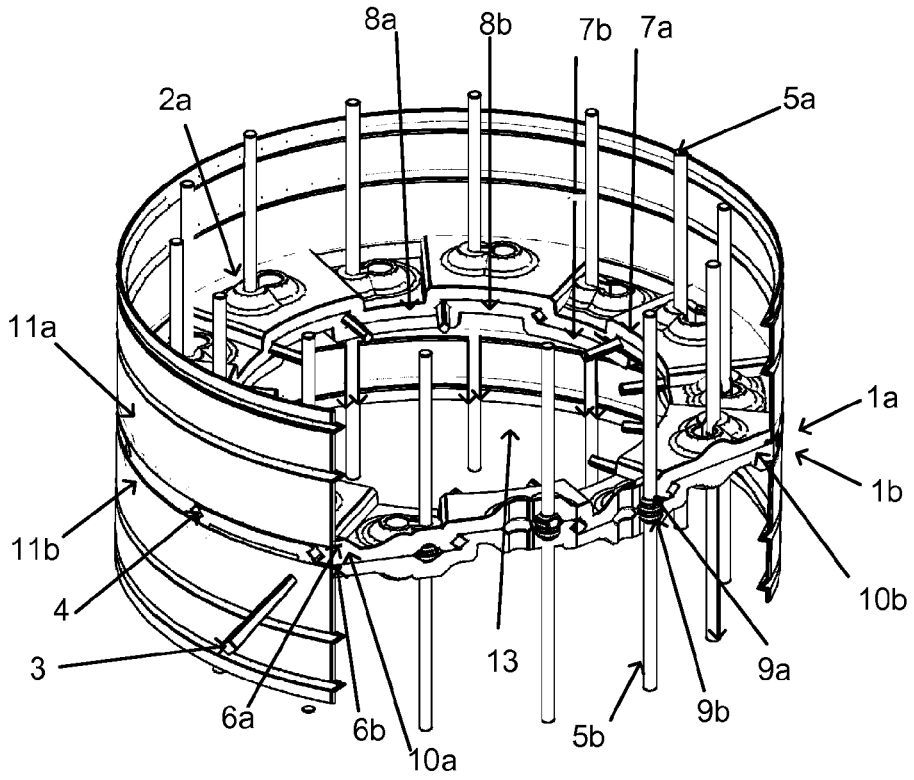
FIG. 12 shows the partial cut away 3D view of the mated the top and bottom indentations to the top and bottom end plates, the top and bottom steel tendons to the top and bottom end plates, and attachment of the top and bottom circular skirt to the top and bottom end plates respectively.
Figure 13:
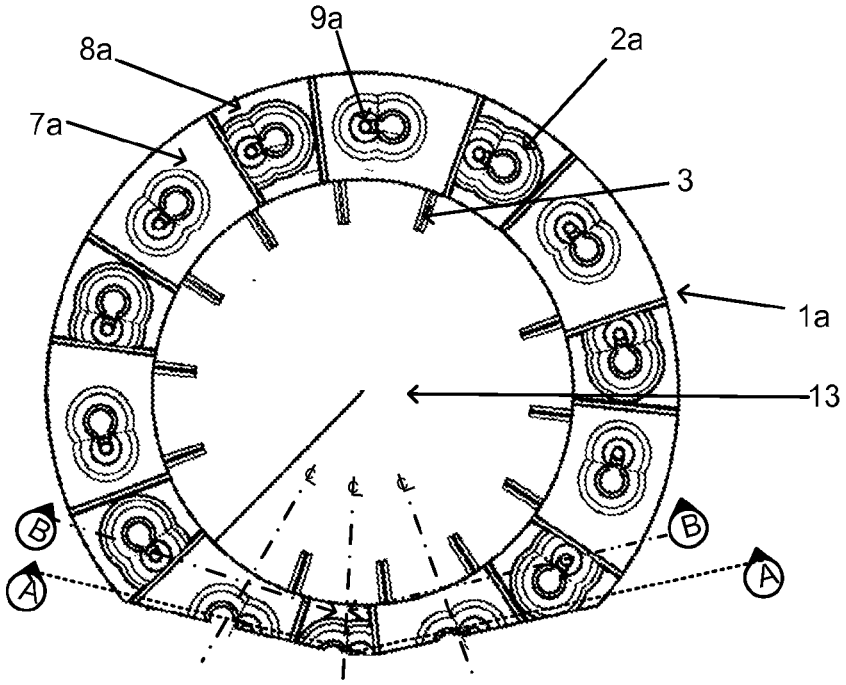
FIG. 13 shows the position of section A-A and section B-B cut of the partial cut away plan view of the mated the top and bottom end plates.
Figure 14:
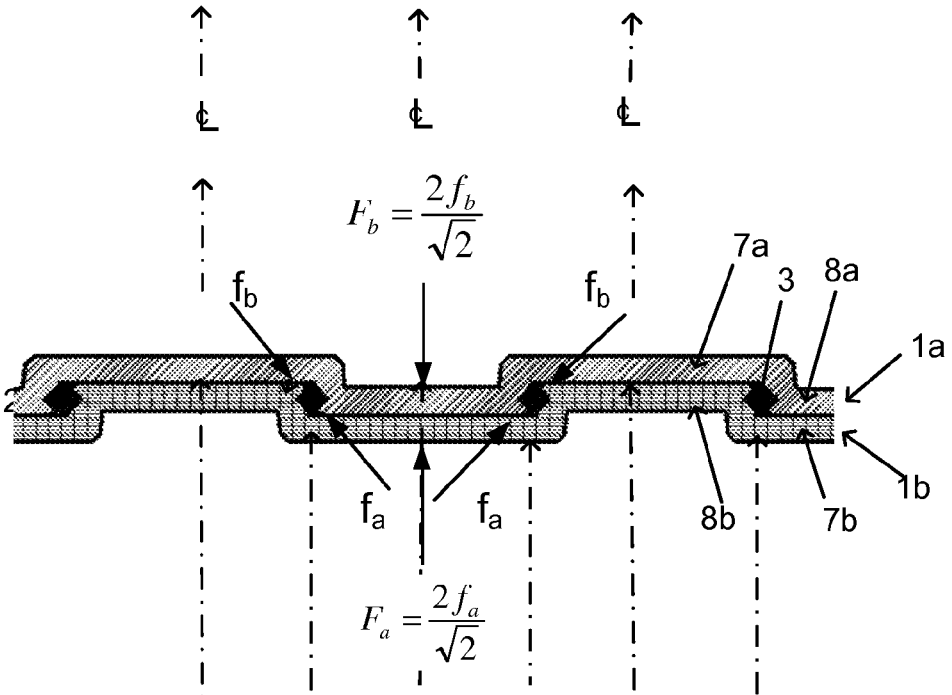
FIG. 14 shows the position of section A-A (FIG. 13) of the partial cut away plan view of the mated the top and bottom end plates with the inserted tapered square pins.
Figure 23:
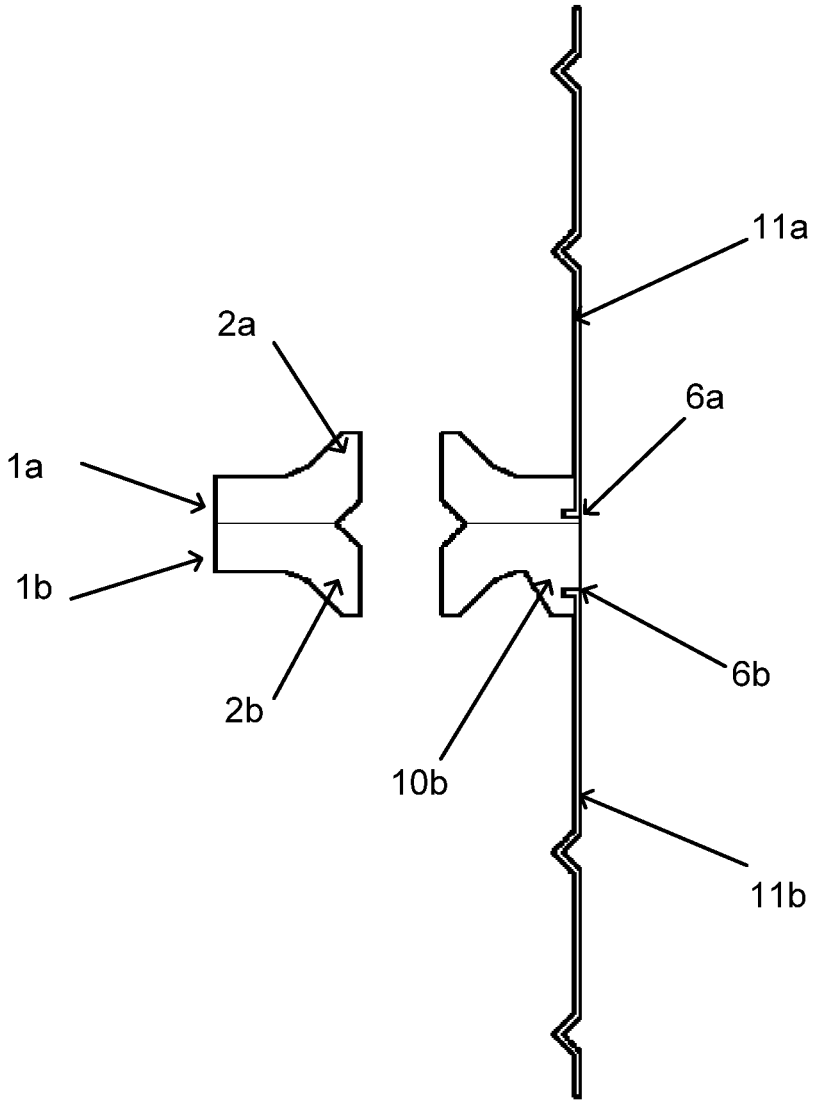
FIG. 23 shows the top and bottom circular skirt and its embedment of one proximal end of the "L-shaped" lip into the circumferential groove in the top and bottom end plate respectively.
Figure 24:
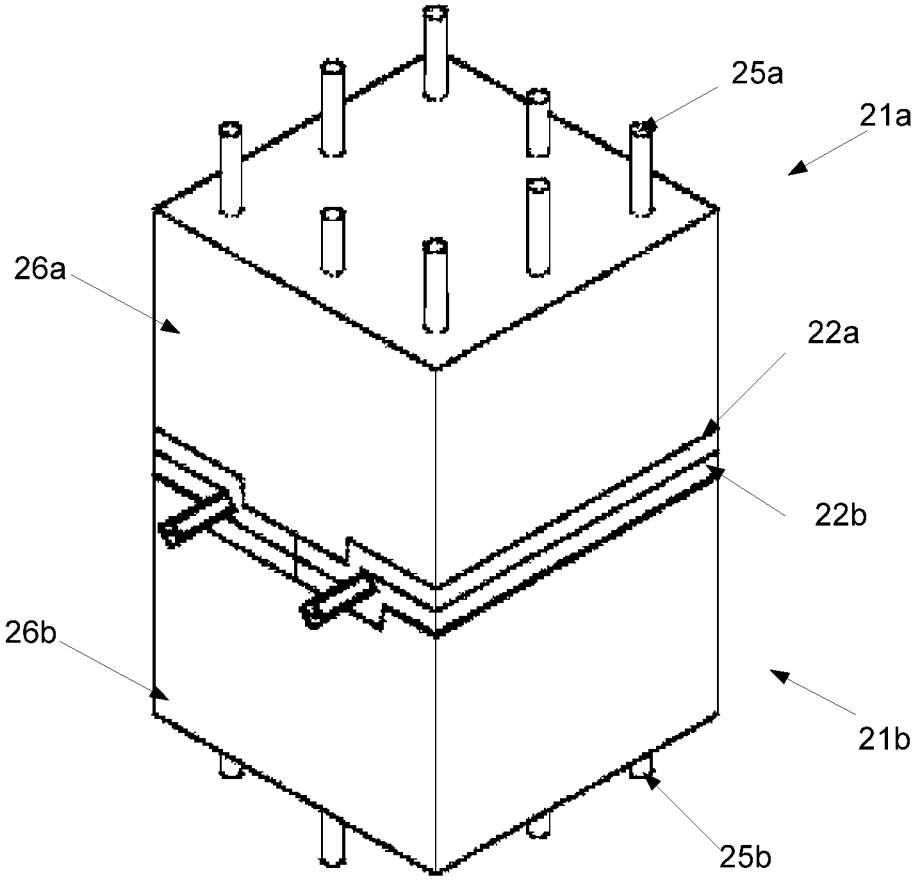
FIG. 24 shows the mated top and bottom square end plates for a solid square piles with the tapered square pins inserted through the openings into the tapered square passageway.

As seen in FIG. 5, FIG. 12 and FIG. 23, there is a thickening at the outer segmental side edges (10*a*,10*b*) on the underside of the segmental protrusions (8*a*,8*b*) in order to create a continuous width all around the end plate whereby a deep rectangular groove (6*a*,6*b*) can traverses the circumference of the end plate (1*a*,1*b*) such that it can embed the proximal lipped edge of the circular steel skirt (11*a*,11*b*). Alternative it the edge of the circular skirt (11*a*, 11*b*) must be corrugated and complex lipped edges must be formed to fit into the rectangular groove made into the sides of the end plate. Another method would be to cut the corrugated edges of the circular steel skirt (11*a*,11*b*) and fully weld to the outer side of the end plate (1*a*,1*b*) but this cumbersome and wasteful. The function of providing a circular skirt (11*a*,11*b*) around the perimeter of the end plate (1*a*,1*b*) is to prevent grout loss and acts as additional confining circumferential stress to prevent the concrete from spalling at the top of the spun pile under explosive impact of the drop hammer.

In a competitive market, it will be necessary to reduce the weight of the end plates (1*a*,1*b*) as there are dead zones in the plates where it is lightly stressed, however the concentrated high prestress tendons (5*a*,5*b*) of 1100 MPa acting on the seat (9*a*,9*b*) causes high localised shear stress leading punching failure which the plate material is likely mild steel. However in this invention, the end plates (1*a*,1*b*) are hot forged in a closed die under high hydraulic force to create the segmental protrusion (8*a*,8*b*) and recesses (7*a*,7*b*) with indentations (2*a*,2*b*) that is drawn at about 30 degrees to 45 degrees to the horizontal plane whereby it create a localised deep profile to overcome the highly stressed zones in tendon seat (9*a*,9*b*) thus allowing weight savings as shown in FIG. 5 and FIG. 23.

Figure 20:
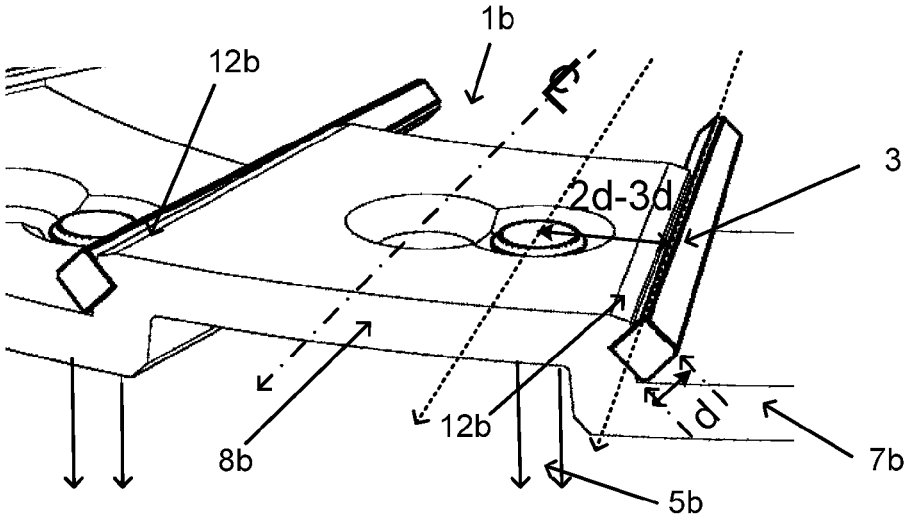
FIG. 20 shows the 3D view of the bottom end plates where there is a sloping edge above the tapered square pin to avoid contact with impact hammer during pile driving thus avoid compressing the dovetail groove.
Figure 21:
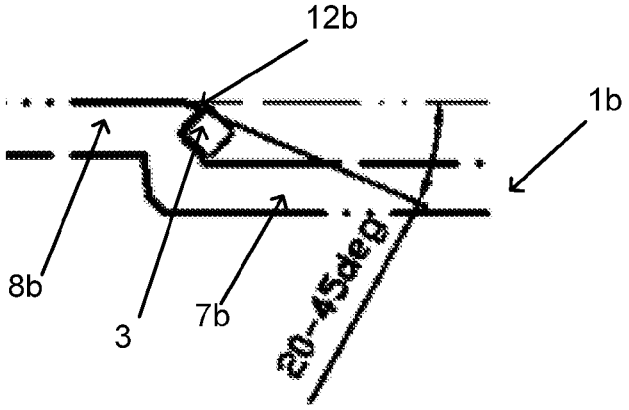
FIG. 21 shows the side view of the sloping edge above the tapered square pin varies from 20 to 45 degrees to the plane of the end plate.
Figure 22:
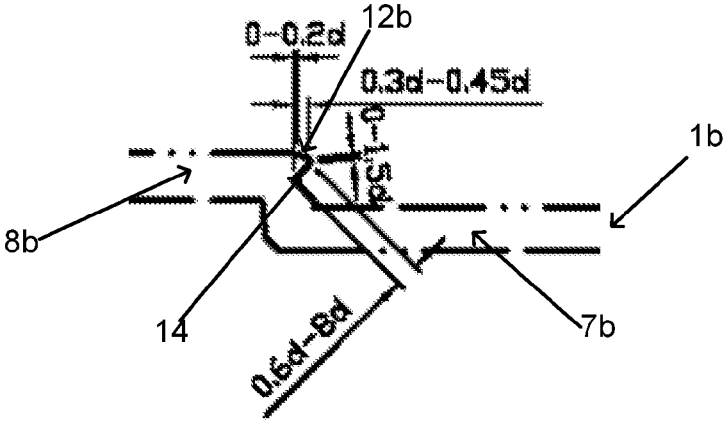
FIG. 22 shows the side view of the dimension of the dovetail groove opening in terms fraction of "d" which is the cross-section width of the square openings (4).

It is common that the contact surface of the hammer may not be completely flat and when pounding on the flat top surface of the end plate (1*a*,1*b*), certain asperities in the hammer surface can damage and compress the edges above the tapered square groove (14) thereby making the tapered square groove (14) to be irregular as seen in FIG. 1, FIG. 20 and FIG. 22. This problem is overcome by cutting a top sloping edge (12*a*,12*b*) on the exposed flat surface to avoid contact with the asperities at the underside of the drop hammer. In addition the angle of the top sloping edge (12*a*,12*b*) is generously angled at 20-45 degrees to the horizontal plane as seen in FIG. 22.

Figure 17:
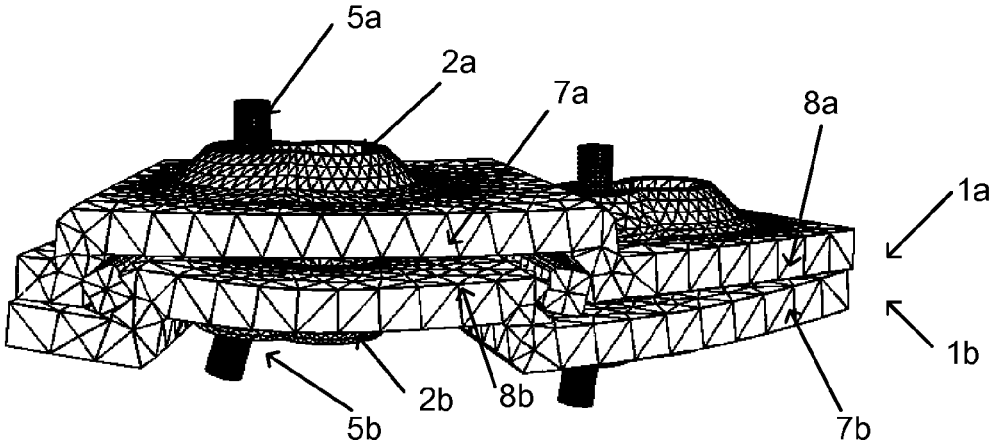
FIG. 17 shows the finite element analysis of a mated top and bottom end plates that has opened up at the contact surface under ultimate failure due to a tension force induced by the steel tendons on to the end plates.
Figure 18:
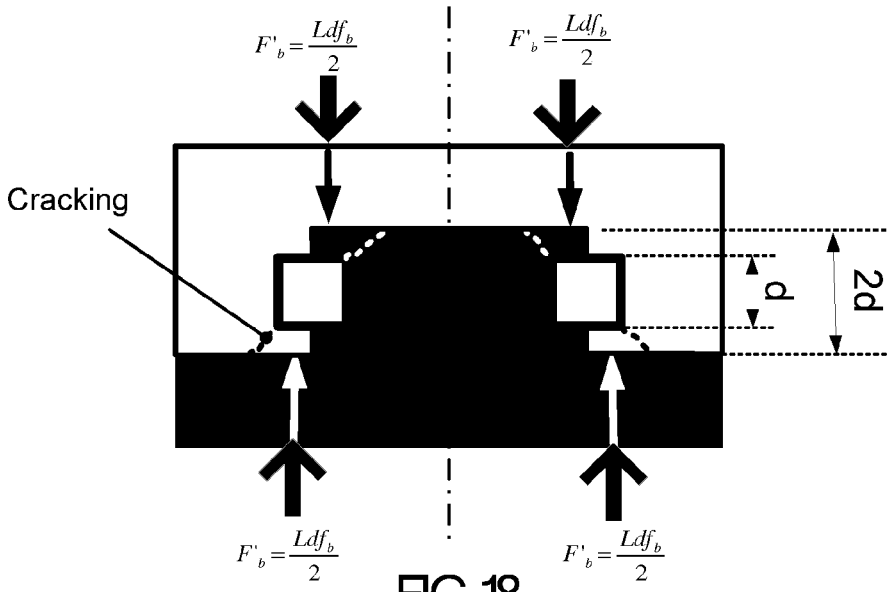
FIG. 18 shows the compression forces derived from a horizontal square pin with a interlocking depth of 2d.
Figure 19:
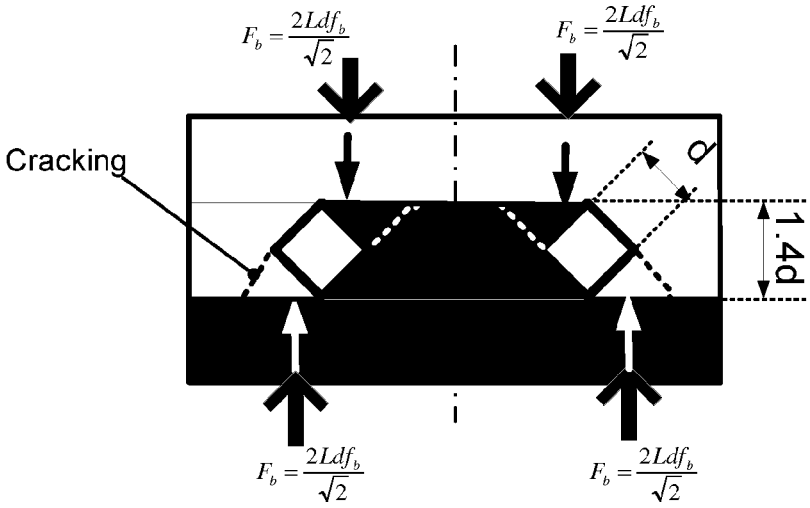
FIG. 19 shows the compression forces derived from a rotated 45 degrees square pin with an interlocking depth of 1.4d, and the formula to compare the compression forces between the horizontal and rotated square pin.

It is normal in most of the mechanical joints in the prior art that the locking pin is likely to be a solid rod which may be tapered, some are solid tabular but placed squarely in a horizontal position into the passageway. From comparing FIG. 18 and FIG. 19, in the present invention differs in the rotating the square pin (3) by 45 degrees to the vertical axis, the edges of the segmental protrusion (8*a*,8*b*) and segmental recesses (7*a*,7*b*) have like dovetail grooves when viewed from the side elevation. This dovetail groove is formed from a concave 90 degrees edge that is rotated by 45 degrees to the axis of the spun pile (16*a*,16*b*) such that the enclosure formed by the two concave 90 degrees edge on one side by the segmental protrusion and the other side by the segmental recess, it results in a 45 degrees rotated square opening (4) on the side elevation of the end plate (1*a*,1*b*). This 45 degrees orientation gives twice the contact surface between the tapered square pin and tapered square passageway and that the critical shear cracking zone is longer and deeper into the endplate (1*a*,1*b*) therefore giving greater shear resistance to avoid the pin from dislodging from the square passageway as seen the FIG. 17. Further for a square opening (4) of width "d", comparing FIG. 19 with the 45 degrees rotated square pin, it is noted that the depth for the segmental protrusion (8*a*,8*b*) and segmental recess (7*a*,7*b*) required is only 1.4d as compared to a minimum of 2d for the normal horizontal square pin in FIG. 18. In addition, the current invention has higher axial compression force of 283% as that for the square pin placed in the horizontal position due to the increase area of contacts between the square pin (3) and the dovetail groove (14). It is also noted that the tapering of the square pin should be about 0.5 to 2 degrees only and when the pin is jammed it, it will not be released as the friction has exceed the sliding of vertical pile under a axial load transmitted to the square pin (3). This jamming of the square pin (3) creates a large expansionary force due to the small taper angle into the tapered square passageway on the opposing contact surfaces along the dovetail grooves (14) of the top segmental protrusion (8*a*,8*b*) and the bottom segmental recess (7*a*,7*b*) which finally presses the mated flat surfaces of the end plates very tightly together hence giving a stiffer performance under a pile bending moment. This effect of this jamming force of the square pin creates a continuous prestressing across the mated end plates (1*a*,1*b*) thus preserving a continuous prestress force along the entire length of the spun pile such that the joint is invisible and can maintain bending moment and tension without initial large rotational displacements.

Figure 15:
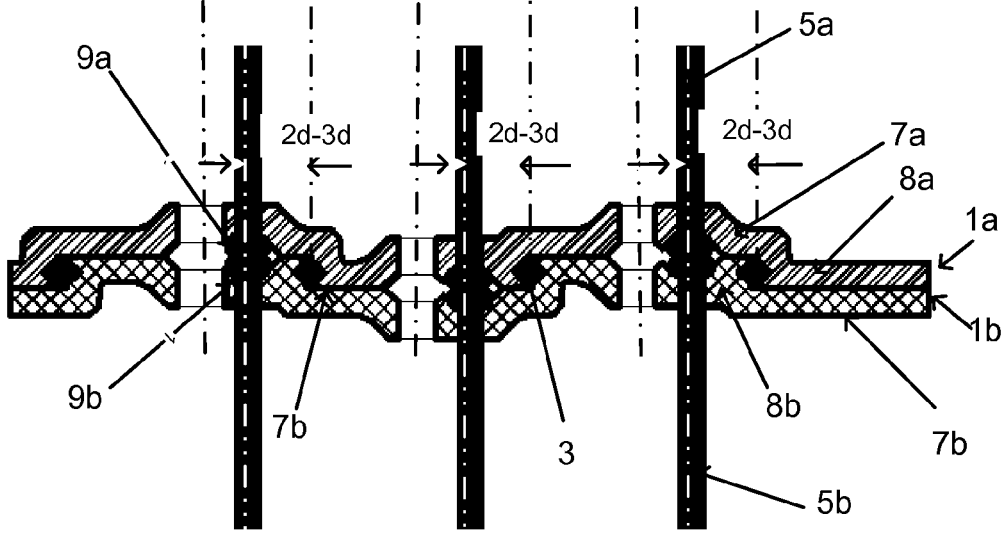
FIG. 15 is a of section B-B (FIG. 13) showing partial cut away plan view of the mated end plates and the steel tendons with the top indentations to the top segmental recesses and protrusions, and the bottom indentations to the bottom segmental recesses and protrusions.
Figure 16:
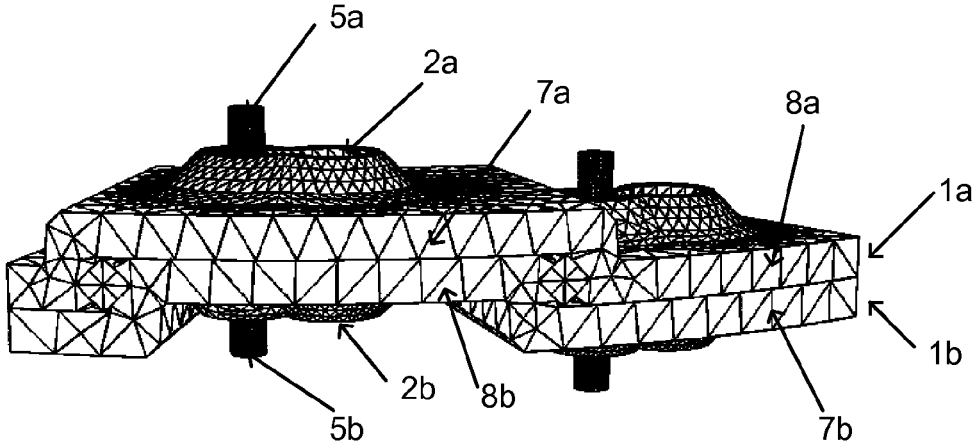
FIG. 16 shows the finite element analysis of a mated top and bottom end plates with the inserted tapered square pins before subjecting to a tension force induced by resistance to the pile bending moment.

Another key feature of the present invention is to enhanced shear transfer and reduced bending in the end plate (1*a*,2*a*) when mated and undergoing severe bending moments. The transfer of tension in the prestressed steel tendons across the connected piles is improved by placing the vertical prestressed tendons (5*a*,5*b*) in close proximity to horizontal interlocked tapered square pins (3) instead of being located at the centre of the segmental protrusions (8*a*,8*b*) or segmental recesses (7*a*,7*b*) as seen in FIG. 15 and unlike as in PI2012700742. As seen in the 5× deformed simulation of the end plate under ultimate bending stress in FIG. 17, the resulting additional tension in the vertical prestressed steel tendons will bends the end plate and open the contact between the end plates (1*a*,1*b*). In the present invention the vertical tendons (5*a*,5*b*) is placed as close to the edge of the dovetail groove (14) at about 2d-3d from the centreline of the vertical tendons (5*a*,5*b*) to the centreline of the square pins as seen in FIG. 15.

Figure 10:
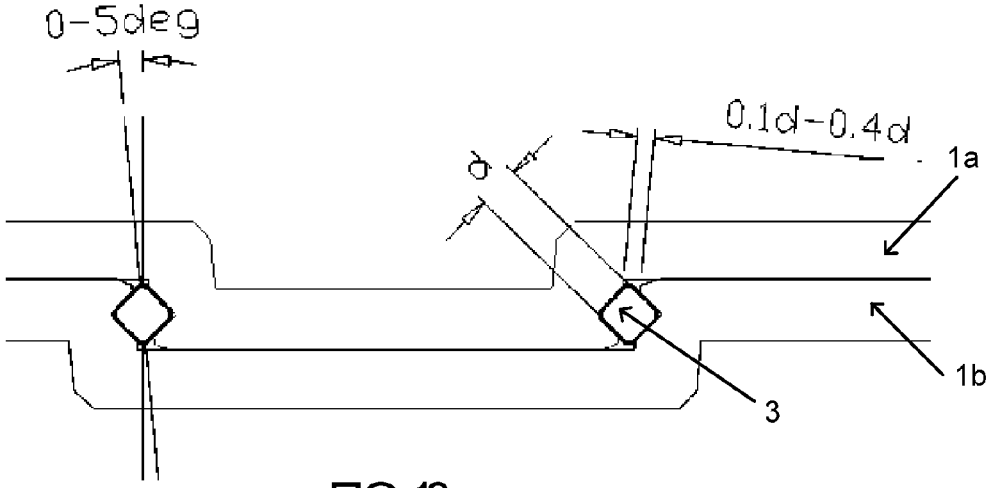
FIG. 10 shows the detailed side view of the vertical alignment of the square passageway at 0-5 degrees to the axis of the pile with a parallel gap of 0.1d to 0.4d between the sides of top segmental protrusion and the bottom segmental recess.
Figure 11:
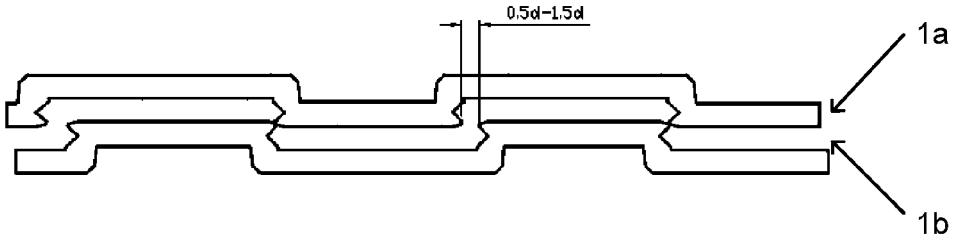
FIG. 11 shows the detailed side view of the gap tolerance opening of 0.5d to 1.5d between the sides of top segmental protrusion and the bottom segmental recess for ease of mating the end plates

Another important aspect of the invention is to make provision for sufficient tolerance during mating of the end plate (1*a*,1*b*) at the site, this is due to manufacturing inaccuracies and for ease of installation. As seen in FIG. 10, there is a large parallel gap width of about 0.1d to 0.4d on each side of the mated dovetail groove (14) when the segmental protrusion (8*a*) adjoins to the segmental recess (7*b*). In addition in FIG. 10, there is a flaring angle of about 0-5 degrees in the segmental recess (7*b*) to receive the segmental protrusion (8*a*). Thus when bringing the top end plate (1*a*) into the mating position with bottom end plate (1*a*) there is a tolerance of 0.5d to 1.5d which makes installation easy.

In another adaptation of the present invention for use in a solid square concrete piles which is more common as compared to square hollow concrete piles. For a square pile without a hollow core, the dovetail groove (14) cannot be arranged to radiate out from a point as there would be congestion. In fact, the alignment of the dovetail groove (14) must avoid a sharp kink angle due to diameter of the dovetail side milling cutter otherwise a length of about half a diameter of the dovetail cutter to a sharp kink angle is obstructed.

Figure 9:
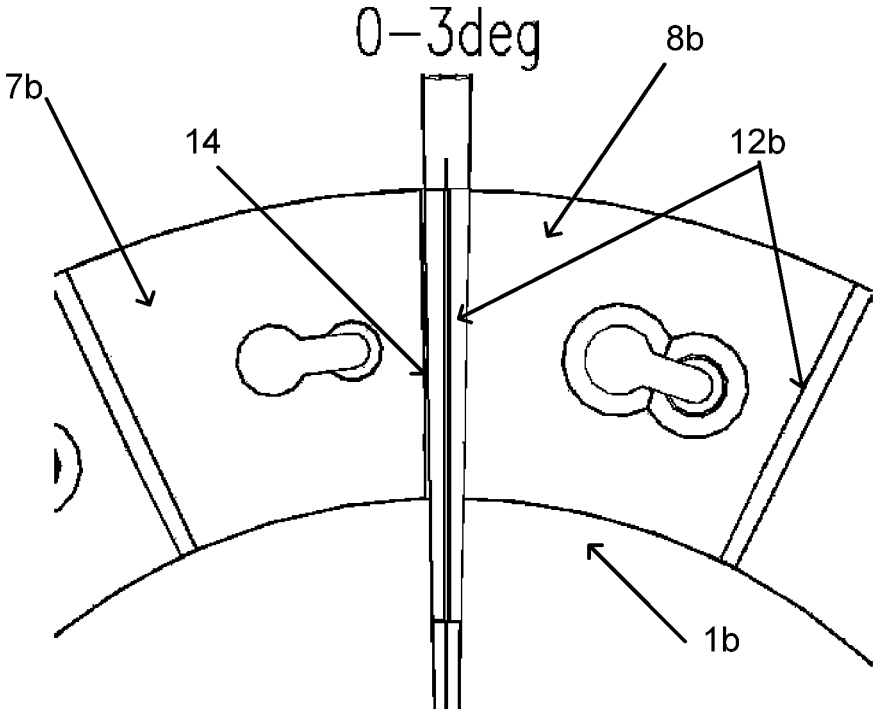
FIG. 9 shows the detailed plan view the tapering alignment of the square passageway from 0-5 degrees towards the center of the annulus end plate
Figure 25:
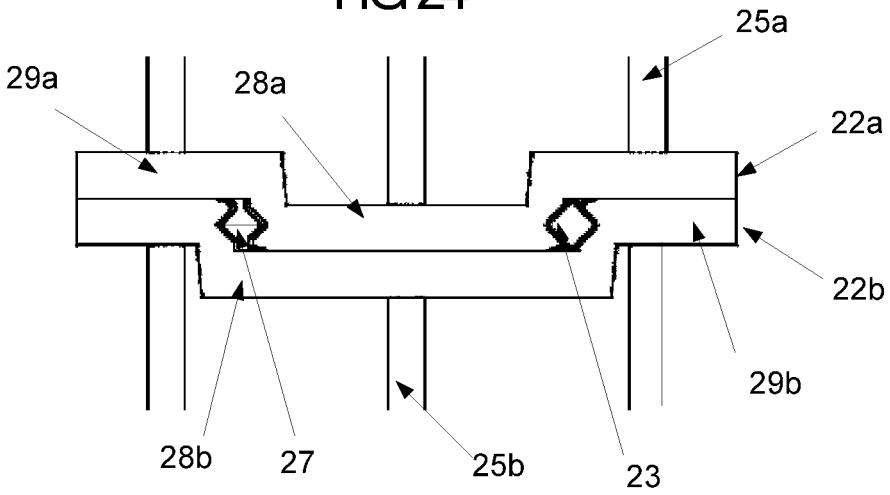
FIG. 25 shows the side view of the mated top and bottom square end plates with the tapered square pins, the top and bottom segmental recesses, the top and bottom segmental protrusions.
Figure 26:
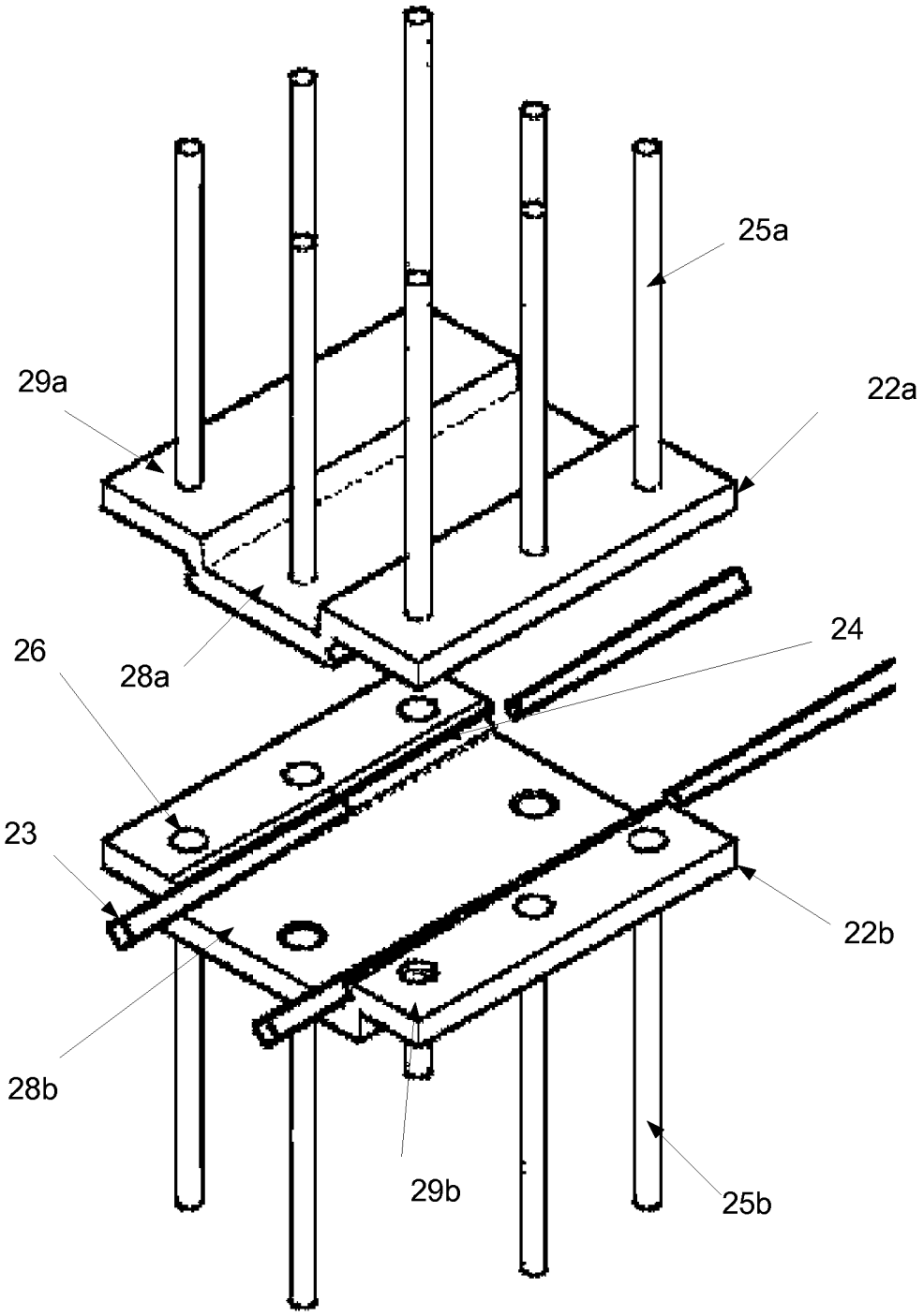
FIG. 26 shows the separated top and bottom solid square piles with the tapered square pins located at the dovetail grooves of the segmental recess of the bottom end plate.

The square end plate (22*a*,22*b*) which is mounted at the ends of a solid square concrete pile (26*a*,26*b*) with steel bars (25*a*,25*b*) welded flush to the top of the square end plate (22*a*,22*b*) does not encounter the problem of the lowered tendon seat (9*a*,9*b*) in the end plate (1*a*,1*b*) for spun pile, moreover the yield stress in the reinforced concrete pile is about 355 MPa to 460 MPa which is less than half of the prestressed tendons, therefore less prone to local punching failure and there is no need for indentations in the square end plate (22*a*,22*b*). This simplifies the manufacturing of the square end plate in that it can be cold formed along straight lines. In FIG. 25 and FIG. 26, the fold lines that form the segmental protrusions (29*a*,29*b*) and segmental recesses (28*a*,28*b*) are nearly straight lines with a kink of not more than 5 degrees. The tapering of the dovetail groove (24) by 0-5 degrees is adopted similarly as illustrated in FIG. 9. One drawback is that the end plates (22*a*,22*b*) are not identical, therefore a male and female end plate must be attached to each ends of the RC pile, and it can only be mated in two orientation by rotating 180 degrees around the vertical axis. The top male square end plate (22*a*) of the top section concrete square pile (26*a*) is mated with the bottom female square end plate (22*b*) of the bottom section concrete square pile (26*b*), a tapered square passageway is formed in each side edge of the segments for insertion of the tapered square pin (23). The square skirt to surround the perimeter of the end cap can be formed from a thin plate and one proximal edge of the inner sides of the square skirt is welded to the outer side of the square end plate (22*a*,22*b*), in this way this welding it is more economical for square piles which is much smaller than spun piles.

The invention claimed is:

1. An end plate system for joining spun piles together, comprising:

a top end plate located at a bottom end of a first spun pile;

a bottom end plate located at a top end of a second spun pile, wherein the end plates each have a plurality of segments comprising an equal number of segmental protrusions and segmental recesses;

wherein each radial side of the segments is provided with tapered grooves;

wherein the tapering of the tapered grooves increases as the tapered grooves extend horizontally towards a vertical center axis of either of the end plates;

a plurality of tapered square pins; and a circular steel skirt;

wherein mating together of the top end plate to the bottom end plate by mating one of the segmental protrusions of the top end plate to one of the segmental recesses of the bottom end plate and mating one of the segmental recesses of the top end plate to one of the segmental protrusions of the bottom end plate forms a plurality of square openings defined by outward ends of the tapered grooves so as to permit the plurality of tapered square pins to be jammed therethrough into a plurality of tapered square passageways defined by adjacent ones of the tapered grooves and in communication with the square openings so as to interlock the top end plate to the bottom end plate;

wherein sloping edges are formed at radial edges of each of the top and bottom end plate segmental protrusions directly above or below the tapered square passageways so as to protect the tapered grooves from damage during impact driving;

wherein outer side edges extend from an underside of each of the top and bottom end plate segmental protrusions such that a continuous circumference is formed on an outer side of the end plates and a rectangular groove traverses the circumference;

wherein the rectangular groove receives a lip of the circular steel skirt.

2. The end plate system according to claim 1, wherein the top end plate is identical to the bottom end plate.

3. The end plate system according to claim 1, wherein the tapered grooves are rotated by 45 degrees relative to an axis perpendicular to a vertical axis of the spun piles.

4. The end plate system according to claim 3, wherein there is a gap of 0.5d to 0.15d between adjacent surfaces of the tapered grooves of the segmental protrusions and the segmental recesses, where d is a cross-sectional width of the square openings.

5. The end plate system according to claim 4, wherein a plane of the gap is rotated from 0-5 degrees from the vertical center axis in a direction that either decreases the gap between the adjacent surfaces of the segmental protrusions and the segmental recesses, or increases the gap between the adjacent surfaces of the segmental recesses and the segmental protrusions.

6. The end plate system according to claim 1, further comprising a plurality of prestressed steel tendon button heads, wherein the segmental protrusions and segmental recesses have indentations to accommodate the prestressed steel tendon button heads, such that the prestressed steel tendon button heads are positioned flush with or below a top surface of either of the end plates.

7. The end plate system according to claim 6, wherein the prestressed steel tendon button heads rest on tendon seats located at a distance of 2d-3d measured from a center of the tendon seats to an axis of the square pins along a perpendicular line to the axis of the square pins, where d is a cross-sectional width of the square openings.

8. The end plate system according to claim 1, wherein the sloping radial edges of the bottom end plate segmental protrusions include a declination of 20-45 degrees downwardly from a horizontal plane of a top flat surface of the bottom end plate in a direction towards the bottom end plate segmental recesses, and wherein the sloping radial edges of the top end plate segmental protrusions include an inclination of 20-45 degrees upwardly from a horizontal plane of a bottom flat surface of the top end plate in a direction towards the top end plate segmental recesses.

9. The end plate system according to claim 1, wherein either of the end plates is hot forged at about 1000° C. from carbon steel, stainless steel or any metallic material in a closed die to form the segmental protrusions and segmental recesses.

10. The end plate system according to claim 1, wherein the tapered square pins are jammed into the tapered square passageways.

11. A square end plate system for joining solid square concrete piles together, comprising:

a top square end plate located at a bottom end of a first solid square concrete pile;

a bottom square end plate located at a top end of a second solid square concrete pile;

wherein each of the top and bottom square end plates have a plurality of segments comprising a number of segmental protrusions and segmental recesses provided with tapered grooves at internal edges of the segments;

wherein the tapering of the tapered grooves increases as the tapered grooves extend horizontally towards a vertical center axis of either of the square end plates; and a plurality of tapered square pins;

wherein mating together of the top square end plate to the bottom square end plate by mating one of the segmental protrusions of the top square end plate to one of the segmental recesses of the bottom square end plate and mating one of the segmental recesses of the top square end plate to one of the segmental protrusions of the bottom square end plate forms a plurality of square openings defined by outward ends of the tapered grooves so as to permit the plurality of tapered square pins to be jammed therethrough into a plurality of tapered square passageways defined by adjacent ones of the tapered grooves and in communication with the square openings so as to interlock the top square end plate to the bottom square end plate;

wherein the top square end plate and bottom square end plate are not identical.

12. The square end plate system according to claim 11, wherein the top square end plate has steel bars welded to a surface thereof and the bottom square end plate has steel bars welded to a surface thereof.

13. The square end plate system according to claim 11, wherein the segment edges that form the segmental protrusions and segmental recesses are substantially straight.

14. The square end plate system according to claim 11, wherein the top end plate and the bottom end plate are cold formed.

15. The square end plate system according to claim 11, wherein the tapered square passageways are rotated by 45 degrees relative to an axis perpendicular to a vertical axis of the solid square concrete piles.

16. The square end plate system according to claim 11, wherein edges of the bottom square end plate segmental protrusions include a declination of 20-45 degrees downwardly from a horizontal plane of a top flat surface of bottom square end plate in a direction towards the bottom square end plate segmental recesses, and wherein edges of the top end plate segmental protrusions include an inclination of 20-45 degrees upwardly from a horizontal plane of a bottom flat surface of the top end plate in a direction towards the top square end plate segmental recesses.

17. The square end plate system according to claim 11, wherein there is a gap of 0.5d to 0.15d between adjacent surfaces of the tapered grooves of the segmental protrusions and the segmental recesses, where d is a cross-sectional width of the square openings.

18. The square end plate system according to claim 17, wherein a plane of the gap is rotated from 0-5 degrees from the vertical center axis in a direction that either decreases the gap between the adjacent surfaces of the segmental protrusions and the segmental recesses, or increases the gap between the adjacent surfaces of the segmental recesses and the segmental protrusions.

* * * * *